US012252886B2

(12) United States Patent
Williams et al.

(10) Patent No.: US 12,252,886 B2
(45) Date of Patent: Mar. 18, 2025

(54) FLOATING MODULAR STAIR SYSTEM

(71) Applicant: CityPost, LLC, Liberty Lake, WA (US)

(72) Inventors: Nathan Adam Williams, Spokane, WA (US); Michael Miles Mosback, Liberty Lake, WA (US); Aleksi Wen Hai Lee, Liberty Lake, WA (US)

(73) Assignee: PrimeSource Building Products, Inc., Irving, TX (US)

( * ) Notice: Subject to any disclaimer, the term of this patent is extended or adjusted under 35 U.S.C. 154(b) by 307 days.

(21) Appl. No.: 17/493,531

(22) Filed: Oct. 4, 2021

(65) Prior Publication Data

US 2022/0349185 A1 Nov. 3, 2022

Related U.S. Application Data

(60) Provisional application No. 63/183,390, filed on May 3, 2021.

(51) Int. Cl.
*E04F 11/00* (2006.01)
*E04B 1/38* (2006.01)
(Continued)

(52) U.S. Cl.
CPC ..... *E04F 11/1041* (2013.01); *E04B 1/388* (2023.08); *E04F 11/028* (2013.01); *E04B 2001/389* (2023.08); *E04F 2011/0209* (2013.01)

(58) Field of Classification Search
CPC ..... E04F 11/00; E04F 11/02; E04F 11/0201; E04F 2011/0203; E04F 11/022;
(Continued)

(56) References Cited

U.S. PATENT DOCUMENTS 2,270,909 A * 1/1942 Spizer ..... A63G 21/02 182/49
3,851,431 A * 12/1974 Klein ..... E04F 11/116 182/217
(Continued)

FOREIGN PATENT DOCUMENTS

CA 2421669 C 5/2012
CN 111255175 6/2020
(Continued)

*Primary Examiner* — Chi Q Nguyen
(74) *Attorney, Agent, or Firm* — Husch Blackwell LLP

(57) ABSTRACT

A floating modular stair system includes a wall mounting plate that is attachable to a vertical wall, and a base mounting plate that is anchorable to a horizontal floor. A monostringer beam is attachable to the wall mounting plate and to the base mounting plate. The monostringer beam includes an integrated hook attachment for variable angle adjustment and attachment to the wall mounting plate. Stair tread brackets are attachable to the monostringer beam for equal spacing of stair treads after installation of the monostringer beam to the wall mounting plate and to the base mounting plate. Each of the stair tread brackets are also designed for individual variable angle adjustment and leveling after attachment to the monostringer beam, and the stair tread brackets are rotatable through an adjustable anchor point about a fixed pivot anchor point to level the stair treads of the floating modular stair system.

20 Claims, 6 Drawing Sheets

(51) Int. Cl.
*E04F 11/028* (2006.01)
*E04F 11/104* (2006.01)
*E04F 11/02* (2006.01)

(58) Field of Classification Search
CPC ... E04F 11/028; E04F 11/104; E04F 11/1041; E04F 2011/0209; E04B 1/388; E04B 2001/389
See application file for complete search history.

(56) References Cited

U.S. PATENT DOCUMENTS 3,866,894 A * 2/1975 Sweet ..... B60G 17/0275 267/31
4,003,179 A * 1/1977 Gilb ..... E04B 1/2612 52/696
4,296,577 A * 10/1981 Schuette ..... E04F 11/035 248/282.1
5,131,197 A * 7/1992 Varga ..... E04F 11/1842 182/228.1
5,197,924 A * 3/1993 Gerrells ..... A63H 33/00 446/168
5,636,483 A 6/1997 Wille
5,657,832 A 8/1997 Stevens
6,868,944 B2 3/2005 Truckner et al.
7,494,419 B2 * 2/2009 Katz ..... A63G 21/00 182/48
7,946,084 B2 * 5/2011 Gibson ..... E04F 11/025 52/182
8,608,580 B2 * 12/2013 Khanna ..... A63G 21/00 472/116
10,745,924 B2 * 8/2020 Jean ..... E04F 21/26
2005/0081461 A1 * 4/2005 Gibson ..... E04F 11/00 52/741.2
2007/0017169 A1 * 1/2007 Gibson ..... E04F 11/025 52/182

FOREIGN PATENT DOCUMENTS

CN 212053527 12/2020
DE 102010023628 12/2011
DE 102010023628 A1 12/2011
KR 20220131064 A * 3/2021 ..... E04F 11/022

* cited by examiner

FLOATING MODULAR STAIR SYSTEM

RELATED APPLICATION

This application claims priority to U.S. Provisional Patent Application Ser. No. 63/183,390 filed May 3, 2021 entitled "Floating Modular Stair System", the disclosure of which is incorporated by reference herein in its entirety.

BACKGROUND

The design and installation of stairs in buildings is challenging, such as during new building construction, particularly to ensure compliance with building codes. Custom, pre-ordered stair systems can be even more challenging given that these types of stair systems require advance ordering well before a projected installation date during the new building construction. Accordingly, this requires careful attention to layout, design, and measurements to ensure that not only will the custom stair system fit precisely as intended, but also to ensure building code compliance for stair tread spacing.

Notably, building codes, such as for residential construction, specify that stair risers should not be more than 7¾ inches in height and that any variation of the stair risers within a flight of stairs should not be more than ⅜ inch throughout the distribution of the stair treads in the flight of stairs. It can be problematic when unforeseen variables during construction shift or change aspects of the building area in which a custom stair system is to be installed, such as changes in ground elevation or building materials that may then lead to a pre-constructed, custom stair system that is out of code compliance after installation.

Given that the stringers and stair tread mounts for custom ordered stair systems are typically all welded together, a custom-welded stair system cannot be modified once it arrives at a building site to overcome or accommodate changing construction conditions. Welding also carries the risk of warping, requires highly-compensated and skilled labor, and is difficult to correct mistakes. Further, if the stringer angle of installation changes and/or the stair tread mounts are not welded at the correct angle for the installation, then all of the stair treads will have a slight lean back or lean forward, which can be very noticeable to a person who uses the stairs, and is also out of building code compliance due the dangers of causing a person to fall on the uneven and/or non-level stairs.

SUMMARY

This Summary introduces features and concepts of a floating modular stair system, which is further described below in the Detailed Description and shown in the Figures. This Summary should not be considered to describe essential features of the claimed subject matter, nor used to determine or limit the scope of the claimed subject matter.

Aspects of a floating modular stair system are described. In implementations, a floating modular stair system includes a wall mounting plate that is attachable to a vertical wall, and a base mounting plate that is anchorable to a horizontal floor. A monostringer beam is attachable to the wall mounting plate and to the base mounting plate. The monostringer beam includes an integrated hook attachment for variable angle adjustment and attachment to the wall mounting plate. The monostringer beam can also include integrated set screw attachments usable to secure the monostringer beam at an installation angle when attached to the wall mounting plate and to the base mounting plate. In an implementation, the monostringer beam can include rail standoffs that are designed for attachment of stair tread brackets to the monostringer beam. The rail standoffs also increase the torsional rigidity of the monostringer beam.

The floating modular stair system includes the stair tread brackets, which are attachable to the monostringer beam for equal spacing of stair treads after installation of the monostringer beam to the wall mounting plate and to the base mounting plate. The stair tread brackets are adjustable after installation to accommodate spacing variances in compliance with building codes, and the stair tread brackets are adjustable for no distribution variation of the stair treads forming a flight of stairs. In an implementation, the stair tread brackets are attachable to a rail standoff of the monostringer beam with compression fittings. Each of the stair tread brackets are also designed for individual variable angle adjustment and leveling after attachment to the monostringer beam, and the stair tread brackets are rotatable through an adjustable anchor point about a fixed pivot anchor point to level the stair treads of the floating modular stair system.

In an implementation of the floating modular stair system, a stair tread bracket includes a stair tread anchor plate configured for attachment of a stair tread, and includes a bracket mounting plate that has an adjustable anchor point, which is rotatable about a fixed pivot anchor point for leveling the stair tread anchor plate. The stair tread bracket can be adjusted to level the stair tread anchor plate after attachment of the bracket mounting plate to the monostringer beam of the floating modular stair system to level the stair tread. In an implementation, the bracket mounting plate can be attached to a rail standoff of the monostringer beam, such as with compression fittings through the adjustable anchor point and the fixed pivot anchor point of the bracket mounting plate.

In an alternate implementation of the floating modular stair system, a stair tread bracket includes a bracket base configured for attachment to the monostringer beam of the floating modular stair system. The bracket base includes variable bracket attachment slots that facilitate translation of the bracket base parallel along the monostringer beam for attachment to the monostringer beam. The stair tread bracket also includes first and second bracket mounting plates that each attach to the bracket base with an adjustable anchor point, which is rotatable about a fixed pivot anchor point for leveling respective first and second stair tread anchor plates that support a stair tread of the floating modular stair system.

The bracket mounting plates are designed for individual leveling of the stair tread anchor plates after attachment to the bracket base to level the stair tread of the floating modular stair system. In an implementation, the first and second bracket mounting plates can each be attached to the bracket base with compression fittings through at least one of the adjustable anchor point and the fixed pivot anchor point. Notably, the monostringer beam is configured for variable angle adjustment, and the first and second bracket mounting plates are designed for individual leveling of the stair tread anchor plates corresponding to the variable angle of the monostringer beam.

BRIEF DESCRIPTION OF THE DRAWINGS

Implementations of a floating modular stair system are described with reference to the following Figures. The same numbers may be used throughout to reference similar features and components that are shown in the Figures.

DETAILED DESCRIPTION

Figure 1:
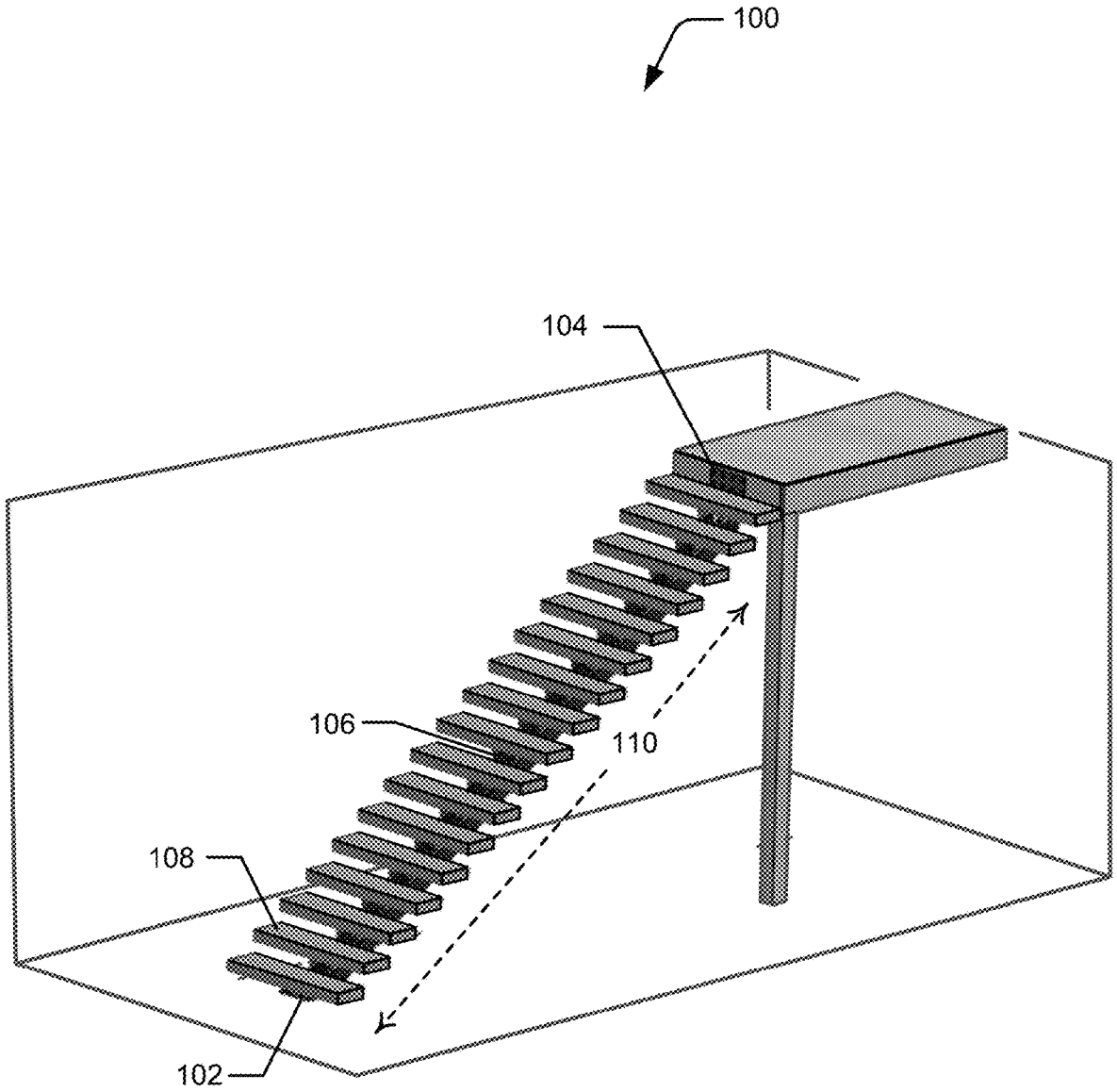
FIG. 1 illustrates an example implementation of a floating modular stair system in accordance with described aspects and features.

A floating modular stair system includes monostringer stair tread brackets designed to facilitate installation and proper, adjustable spacing of stair treads during and even after installation of the floating modular stair system, such as during a new building construction. As described herein, a monostringer stair system is designed with modular components, including base and wall mounting plates, between which a monostringer beam is attached and can be angled and adjusted during installation to accommodate any construction variances. The monostringer beam runs from up on the wall mounting plate down to the base mounting plate on the floor. Further, the monostringer beam has mount provisions that allow for variable, adjustable placement of the stair tread brackets. In an example implementation, the monostringer beam has rail standoffs on which the stair tread brackets can then be installed with compression fittings that hold the brackets in position on the rail standoffs of the monostringer beam.

The attachment of the monostringer beam is modular, customizable, and easily installed. In an implementation, a hook attachment is integrated in the monostringer beam that allows for infinitely variable stair angle attachments to both the wall mounting plate and to the base mounting plate. The design also includes set screws that secure the monostringer beam at the final installation angle with set screw nuts when anchored to the wall mounting plate and to the base mounting plate. Additionally, the monostringer beam has a torsionally rigid beam design that allows the stair tread brackets to be placed at any location along its length. In an example implementation, the rail standoff attachments integrated with the monostringer beam add to the torsional rigidity of the beam.

The stair tread brackets provide for multiple adjustments both during and after installation of the modular stair system, notably being adjustable during installation to properly space the stair treads in accordance with building codes. This is a simple calculation of the vertical rise divided by the maximum riser height to determine the number of stair treads along the span of the monostringer beam for commercial and residential building code compliance. The result will be evenly spaced stair treads with little to no variation in the distribution of the stair risers throughout the flight of stairs.

In an alternate implementation, a bracket system includes separable stair tread anchor plates and a bracket base (also referred to as a carrier bracket), which is a separate carrier piece that will mount onto the monostringer beam instead of clamping to the flanges or the rail standoff attachments on the monostringer beam. The bracket base can be locked to the monostringer beam using bolts, and the bracket base includes variable bracket slots that allow for variable adjustability along the beam, provided by the slot pattern in the bracket base carrier and a treaded hole pattern in the beam. Once the bracket base carrier is positioned and affixed to the monostringer beam, the adjustable tread mount anchor plates affix to the bracket base carrier, such as with a slot and clamp, or with any other type of connection, that facilitates individual leveling the stair treads that are mounted on the stair tread anchor plates.

Not only can all of the stair tread brackets (in either type of design or implementation) be uniformly spaced at the time of installation, each stair tread bracket is designed for individual variable angle adjustment and is rotatable through at least twenty degrees (20°). This easily allows for individual horizontal alignment and leveling of each installed stair tread directly during installation. Overall, the floating modular stair system does not require any installation welding or metal drilling of the monostringer beam at the installation site, and provides significant installation flexibility and adjustability. Notably, there is flexibility to adjust for on-site installation variances in the base mounting plate to the monostringer beam connection; in the monostringer beam to wall mounting plate connection; in the distribution and positioning of the stair tread brackets along the angled span of the monostringer beam; and in the rotatable adjustment of each individual stair tread bracket that facilitates horizontal leveling of each installed stair tread.

While features and concepts of a floating modular stair system can be implemented in any number of different devices, assemblies, systems, environments, and/or configurations, implementations of a floating modular stair system are described in the context of the following example devices, assemblies, and methods.

FIG. 1 illustrates an example of a floating modular stair system 100 as described herein, and also referred to as a monostringer stair system and/or a modular stair system. The floating modular stair system 100 is designed with modular components, including a base mounting plate 102 and a wall mounting plate 104, between which a monostringer beam 106 is attached and can be angled and adjusted during installation to accommodate any construction variances. The monostringer beam 106 runs from up on the wall mounting plate 104 down to the base mounting plate 102 on the floor. Further, the monostringer beam 106 has mount provisions that allow for variable, adjustable placement of stair tread brackets that support the stair treads 108 of the floating modular stair system. These features are further shown and described with reference to FIGS. 2-6.

The stair tread brackets, as shown in FIGS. 3-6, provide for multiple adjustments both during and after installation of the floating modular stair system, notably being adjustable during installation to properly space the stair treads 108 in accordance with building codes, as shown at 110. This is a simple calculation of the vertical rise divided by the maximum riser height to determine the number of stair treads along the span of the monostringer beam for commercial and residential building code compliance. The result will be evenly spaced stair treads 108 with little to no variation in the distribution of the stair risers throughout the flight of stairs.

Figure 2:
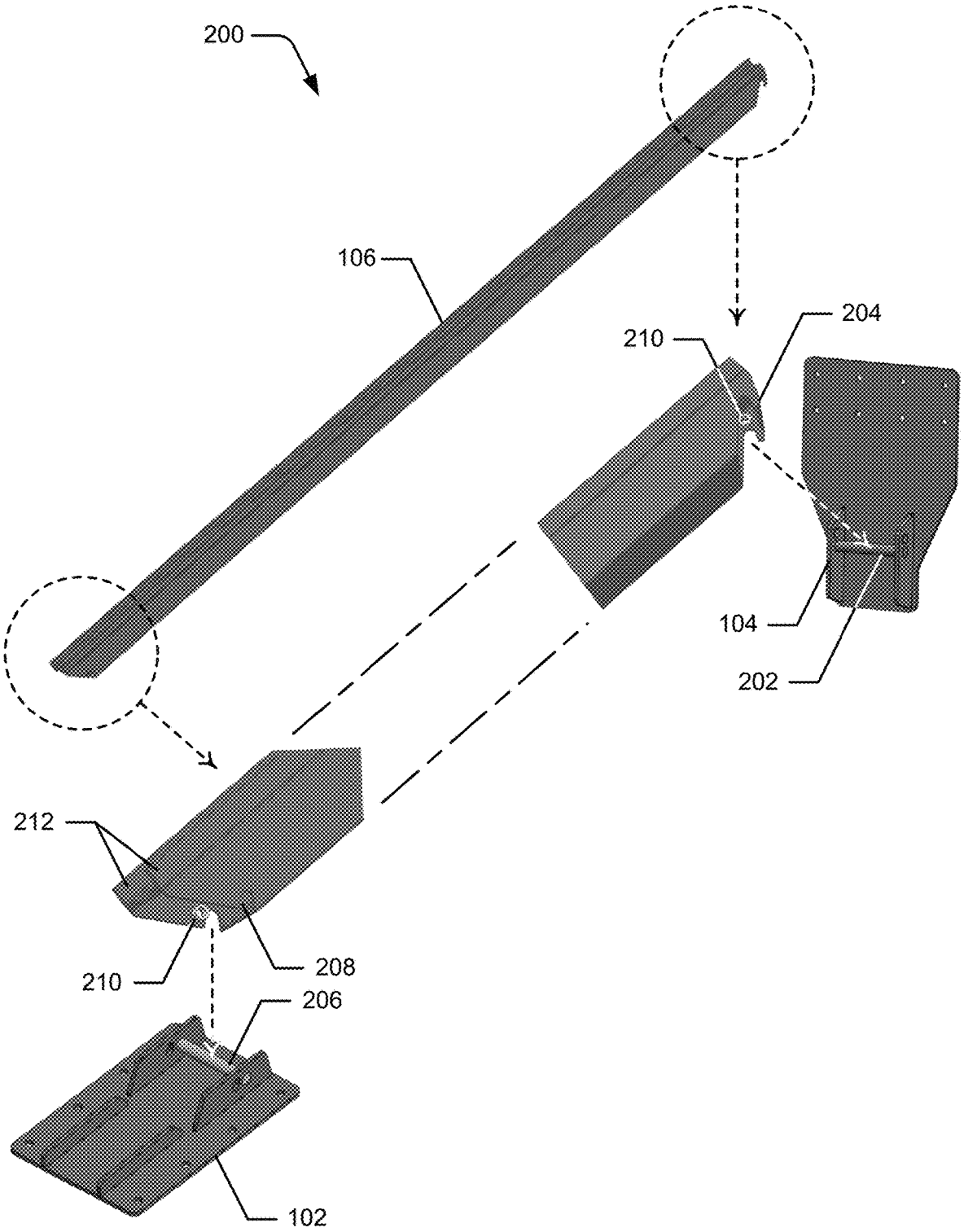
FIG. 2 illustrates examples of modular components of the floating modular stair system.

FIG. 2 illustrates examples 200 of modular components of the floating modular stair system 100, including the base mounting plate 102 and the wall mounting plate 104, between which the monostringer beam 106 is attached. In implementations and for stability, the base mounting plate 102 is anchorable to a horizontal floor, and the wall mounting plate 104 is attachable to a vertical wall or other structure of a building. The monostringer beam 106 is then attachable to the wall mounting plate 104 and to the base mounting plate 102. The wall mounting plate 104 has an integrated hook support 202, which correlates with an integrated hook attachment 204 of the monostringer beam 106 that hook-engages the integrated hook support 202 of the wall mounting plate. The integrated hook attachment 204 of the monostringer beam 106 provides for variable angle adjustment and attachment when hook-engaged with the integrated hook support 202 to the wall mounting plate.

Similarly, the base mounting plate 102 has an integrated attachment support 206, which correlates with an integrated slot attachment 208 of the monostringer beam 106 that slot-engages the integrated attachment support 206 of the base mounting plate. The integrated hook attachment 204 of the monostringer beam 106 that correlates with and hook-engages the integrated hook support 202 of the wall mounting plate 104, and the integrated slot attachment 208 of the monostringer beam 106 that correlates with and slot-engages the integrated attachment support 206 of the base mounting plate 102, allows for infinitely variable stair angle attachments to both the wall mounting plate and to the base mounting plate.

The monostringer beam 106 also includes integrated set screw attachments 210 configured to secure the monostringer beam 106 at an installation angle when attached to the wall mounting plate 104 and to the base mounting plate 102. For example, the design can include set screws that secure the monostringer beam 106 at the final installation angle with set screw nuts (e.g., the set screw attachments 210) when anchored to the wall mounting plate and to the base mounting plate. In an implementation, the monostringer beam 106 can include rail standoffs 212 designed for attachment of the stair tread brackets to the monostringer beam. The monostringer beam 106 has a torsionally rigid beam design that allows the stair tread brackets to be placed at any location along its length, and the rail standoffs 212 integrated with the monostringer beam add to the torsional rigidity of the beam.

Figure 3:
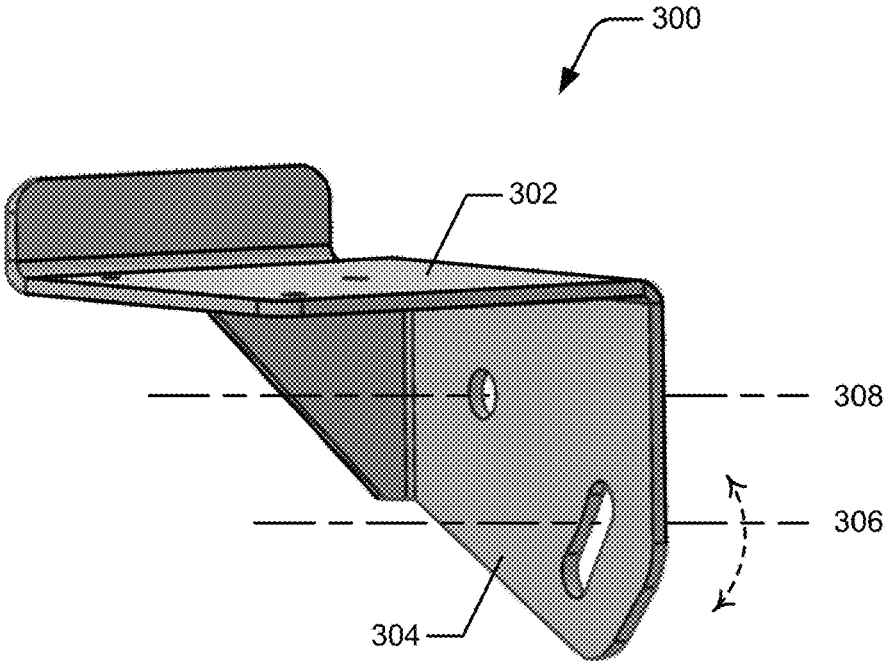
FIGS. 3-5 illustrate an example implementation of a stair tread bracket of the floating modular stair system in accordance with one or more implementations.
Figure 4:
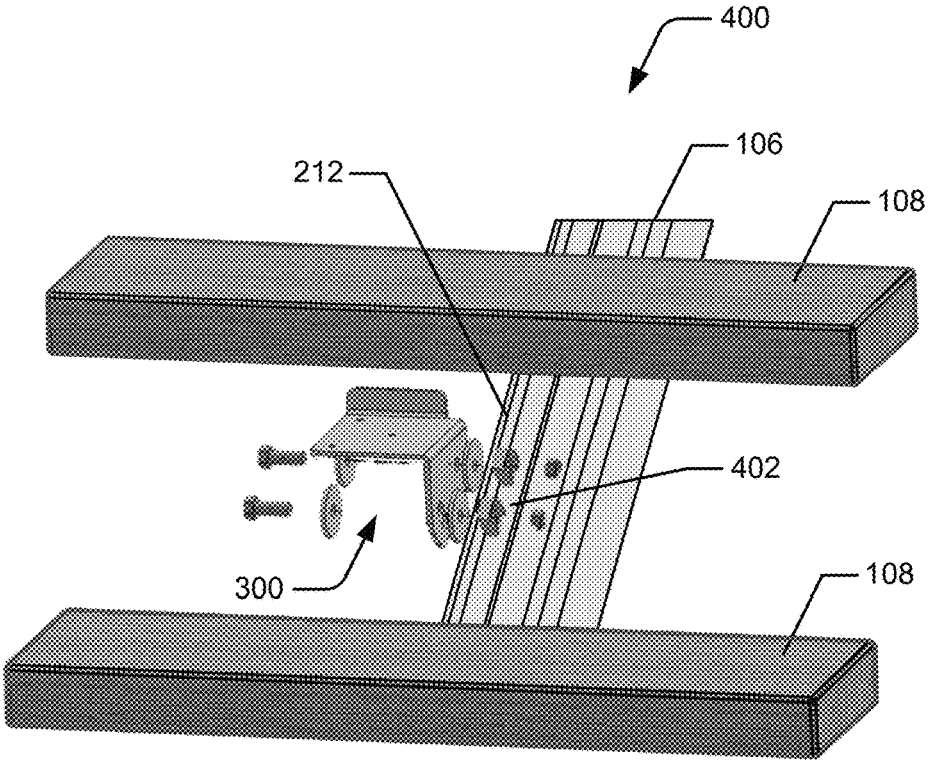
Figure 5:
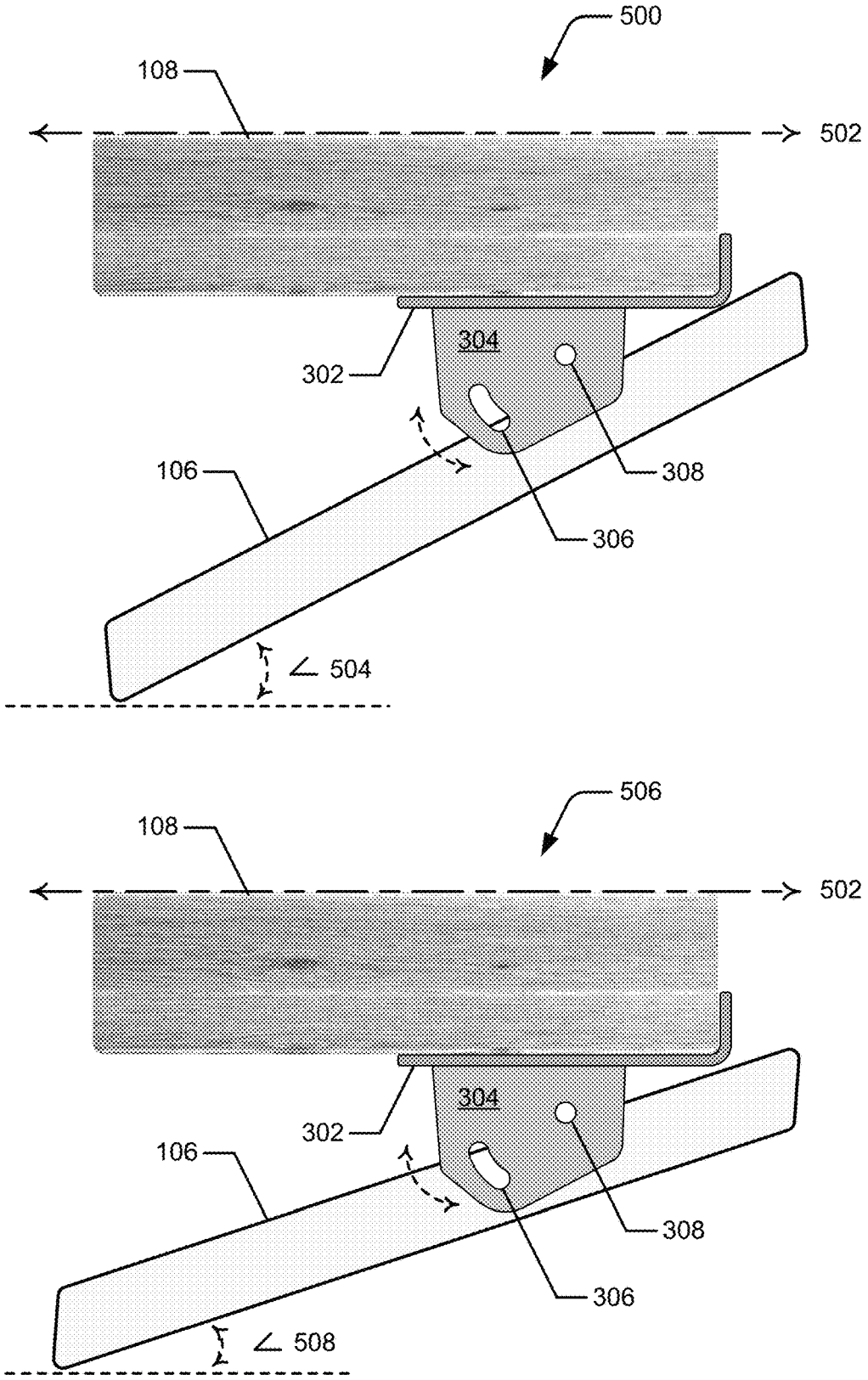

FIGS. 3-5 illustrate an example of a stair tread bracket 300 of the floating modular stair system 100. In an implementation shown in FIG. 3, the stair tread bracket 300 includes a stair tread anchor plate 302 for attachment of a stair tread 108, and also includes a bracket mounting plate 304 configured with an adjustable anchor point 306 that is rotatable about a fixed pivot anchor point 308 for leveling the stair tread anchor plate 302 (and the stair tread attached thereto). The stair tread bracket 300 is designed for leveling of the stair tread anchor plate 302 after attachment of the bracket mounting plate 304 to the monostringer beam 106 of the floating modular stair system to level the stair tread. The stair tread brackets 300 are attachable to the monostringer beam 106 and adjustable for equal spacing of the stair treads 108 after installation of the monostringer beam 106 to the wall mounting plate 104 and to the base mounting plate 102.

As further shown in an example 400 in FIG. 4, the bracket mounting plate 304 of the stair tread bracket 300 is designed for attachment to a rail standoff 212 of the monostringer beam 106, such as with compression fittings 402 through the adjustable anchor point 306 and the fixed pivot anchor point 308 of the bracket mounting plate. The stair tread brackets 300 are adjustable after installation on the monostringer beam 106 to accommodate spacing variances in compliance with building codes, and the stair tread brackets are adjustable for no distribution variation of the stair treads 108 forming a flight of stairs.

As further shown in FIG. 5, the stair tread bracket 300 is designed for individual leveling of the stair tread anchor plate 302 after attachment to the monostringer beam 106 to level the stair tread 108 that is attached to the stair tread anchor plate. Notably, each of the stair tread brackets 300 of the floating modular stair system 100 are configured for individual variable angle adjustment and leveling, being rotatable through the adjustable anchor point 306 about the fixed pivot anchor point 308 of the bracket mounting plate 304. As shown at 500, the level 502 of the stair tread 108 can be maintained at any arbitrary angle 504 of the monostringer beam 106. Similarly, as shown at 506, the level 502 of the stair tread 108 can be maintained at a relatively lesser angle 508 than the arbitrary angle 504 of the monostringer beam 106. Comparatively, the arbitrary angle 504 of the monostringer beam 106 is greater than the lesser angle 508 of the monostringer beam, in this example.

Figure 6:
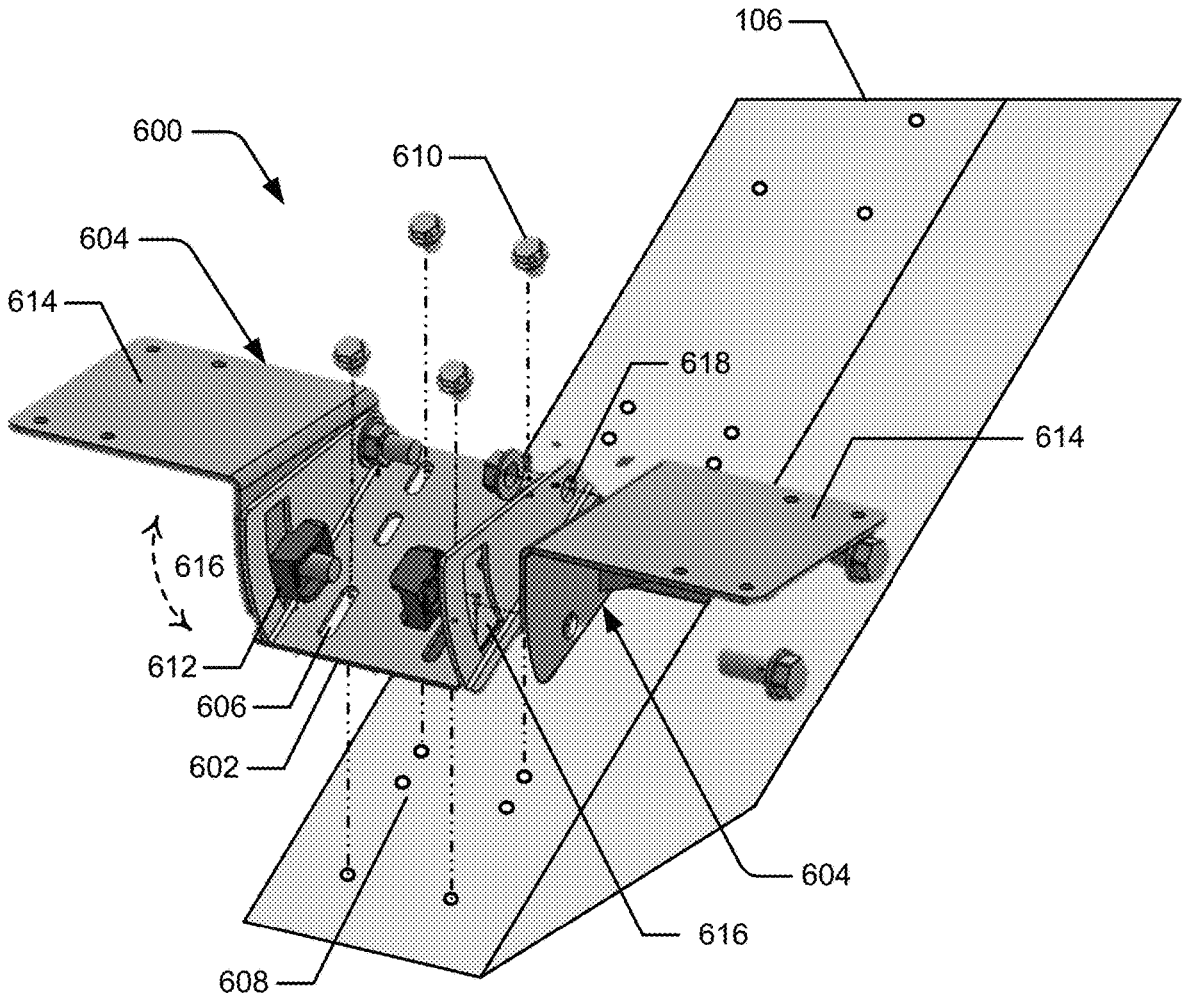
FIG. 6 illustrates another example implementation of a stair tread bracket of the floating modular stair system in accordance with one or more implementations.

FIG. 6 illustrates another example implementation of a stair tread bracket 600 of the floating modular stair system 100. In this implementation, the stair tread bracket 600 is a multi-part bracket system that includes a bracket base 602 (also referred to as a carrier bracket) for attachment to the monostringer beam 106, and includes bracket mounting plates 604, which are attachable to the bracket base 602 and configured to support a stair tread 108. The bracket base 602 includes variable bracket attachment slots 606 designed to facilitate translation of the bracket base parallel along the monostringer beam 106 for attachment to a treaded hole pattern 608 in the monostringer beam. The bracket base 602 can be locked or otherwise attached to the monostringer beam 106 using bolts 610 through the variable bracket attachment slots 606 in the bracket base and into the monostringer beam.

Once the bracket base 602 is positioned and affixed to the monostringer beam 106, the bracket mounting plates 604 affix to the bracket base, such as with a slot and clamp, compression fittings 612, and/or any other type of attachable connection that facilitates leveling the stair treads 108 that are mounted on stair tread anchor plates 614 of the bracket mounting plates. The bracket mounting plates 604 are designed for attachment to the bracket base 602 via an adjustable anchor point 616 that is rotatable about a fixed pivot anchor point 618. The adjustability facilitates leveling the stair tread anchor plates 614 of the bracket mounting plates 604, which support a stair tread 108 of the floating modular stair system. The bracket mounting plates 604 are designed for individual leveling of the stair tread anchor plates 614 after attachment to the bracket base 602 to level the stair tread 108 corresponding to the variable angles of the monostringer beam.

Not only can all of the stair tread brackets (in either type of design or implementation of stair tread brackets 300, 600) be uniformly spaced at the time of installation, such as on a job site, each stair tread bracket 300, 600 is designed for individual variable angle adjustment and is rotatable through at least twenty degrees (20°). This easily allows for individual horizontal alignment and leveling of each installed stair tread directly during installation, as shown in the example figures. Overall, the floating modular stair system 100 does not require any installation welding or metal drilling of the monostringer beam 106 at the installation site, and provides significant installation flexibility and adjustability. Notably, there is flexibility to adjust for on-site installation variances in the base mounting plate 102 to the monostringer beam 106 connection; in the monostringer beam 106 to wall mounting plate 104 connection; in the distribution and positioning of the stair tread brackets 300, 600 along the angled span of the monostringer beam; and in the rotatable leveling adjustment of each individual stair tread bracket 300, 600 that facilitates horizontal leveling of each installed stair tread.

Figure 7:
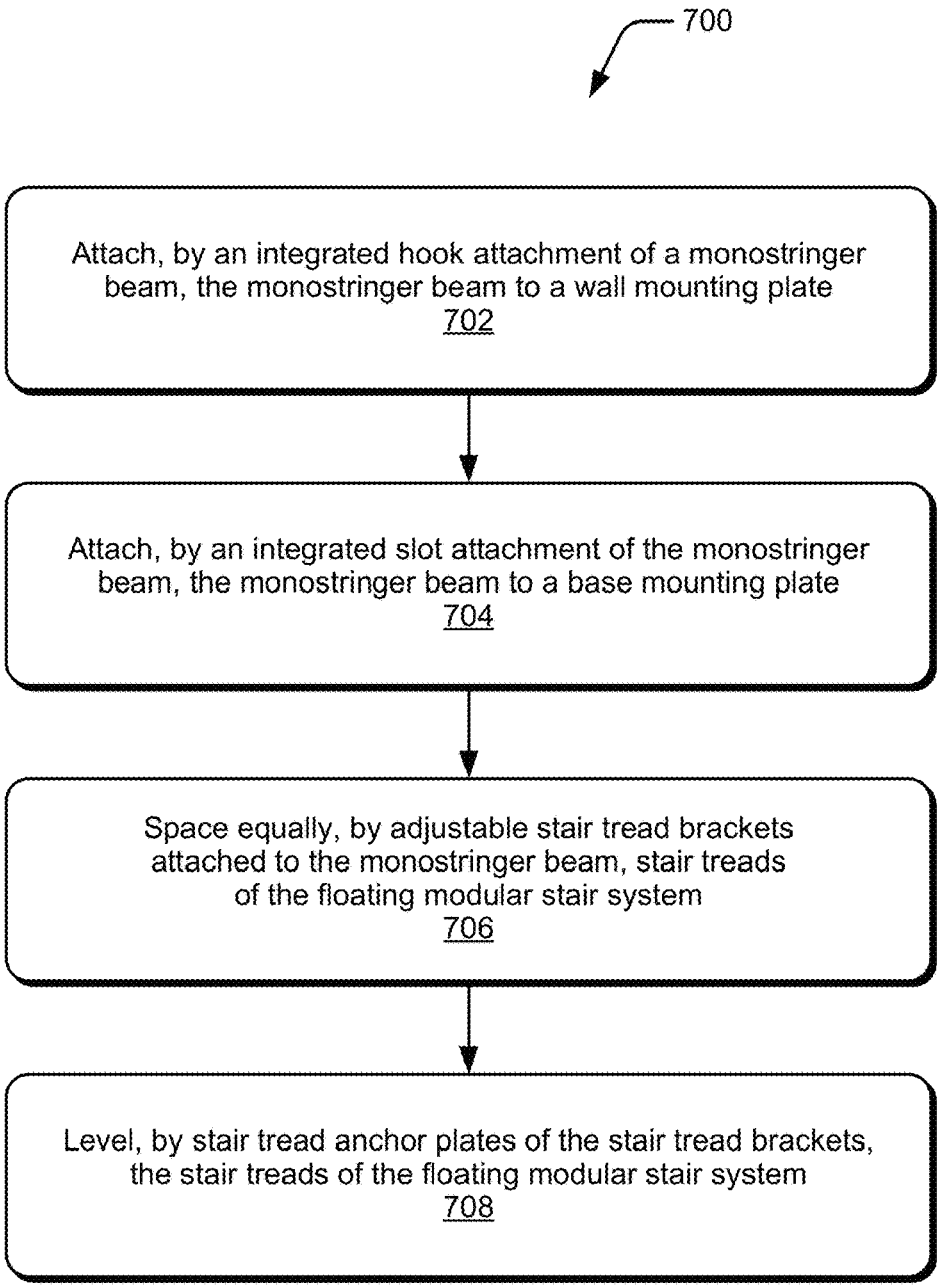
FIG. 7 illustrates an example method for a floating modular stair system in accordance with one or more implementations.

FIG. 7 illustrates example method(s) 700 for a floating modular stair system. The order in which the method is described is not intended to be construed as a limitation, and any number or combination of the method operations can be combined in any order to implement a method, or an alternate method.

At 702, attach, by an integrated hook attachment of a monostringer beam, the monostringer beam to a wall mounting plate. For example, the wall mounting plate 104 is attachable to a vertical wall (or similar structure) and has the integrated hook support 202, which correlates with the integrated hook attachment 204 of the monostringer beam 106 that hook-engages the integrated hook support 202 of the wall mounting plate. The integrated hook attachment 204 of the monostringer beam 106 provides for variable angle adjustment and attachment when hook-engaged with the integrated hook support 202 to the wall mounting plate.

At 704, attach, by an integrated slot attachment of the monostringer beam, the monostringer beam to a base mounting plate. For example, the base mounting plate 102 is anchorable to a horizontal floor and has the integrated attachment support 206, which correlates with the integrated slot attachment 208 of the monostringer beam 106 that slot-engages the integrated attachment support 206 of the base mounting plate. The integrated hook attachment 204 of the monostringer beam 106 that correlates with and hook-engages the integrated hook support 202 of the wall mounting plate 104, and the integrated slot attachment 208 of the monostringer beam 106 that correlates with and slot-engages the integrated attachment support 206 of the base mounting plate 102, allows for infinitely variable stair angle attachments to both the wall mounting plate and to the base mounting plate.

At 706, space equally, by adjustable stair tread brackets attached to the monostringer beam, stair treads of the floating modular stair system. For example, the stair tread brackets 300, 600 are attachable to the monostringer beam 106 and adjustable for equal spacing of the stair treads 108 after installation of the monostringer beam 106 to the wall mounting plate 104 and to the base mounting plate 102. The stair tread brackets 300, 600 are adjustable after installation on the monostringer beam 106 to accommodate spacing variances in compliance with building codes, and the stair tread brackets are adjustable for no distribution variation of the stair treads 108 forming a flight of stairs.

At 708, level, by stair tread anchor plates of the stair tread brackets, the stair treads of the floating modular stair system. For example, the stair tread bracket 300 is designed for individual leveling of the stair tread anchor plate 302 after attachment to the monostringer beam 106 to level the stair tread 108 that is attached to the stair tread anchor plate. Similarly, the bracket mounting plates 604 are designed for individual leveling of the stair tread anchor plates 614 after attachment to the bracket base 602 to level the stair tread 108 corresponding to the variable angles of the monostringer beam. Notably, each of the stair tread brackets 300, 600 of the floating modular stair system 100 are configured for individual variable angle adjustment and leveling, being rotatable through the adjustable anchor points about the fixed pivot anchor points of the brackets.

Although implementations of a floating modular stair system have been described in language specific to features and/or methods, the appended claims are not necessarily limited to the specific features or methods described. Rather, the specific features and methods are disclosed as example implementations of a floating modular stair system, and other equivalent features and methods are intended to be within the scope of the appended claims. Further, various different examples are described and it is to be appreciated that each described example can be implemented independently or in connection with one or more other described examples.

The invention claimed is:

1. A floating modular stair system, comprising:

a wall mounting plate attachable to a vertical wall;

a base mounting plate anchorable to a horizontal floor;

a monostringer beam attachable to the wall mounting plate and to the base mounting plate, the monostringer beam including an integrated hook attachment configured for variable angle adjustment and attachment to the wall mounting plate; and stair tread brackets attachable to the monostringer beam for equal spacing of stair treads after installation of the monostringer beam to the wall mounting plate and to the base mounting plate.

2. The floating modular stair system of claim 1, wherein the stair tread brackets are adjustable after the installation to accommodate spacing variances in compliance with building codes.

3. The floating modular stair system of claim 1, wherein the stair tread brackets are adjustable for no distribution variation of the stair treads forming a flight of stairs.

4. The floating modular stair system of claim 1, wherein the monostringer beam includes integrated set screw attachments configured to secure the monostringer beam at an installation angle of the monostringer beam attached to the wall mounting plate and to the base mounting plate.

5. The floating modular stair system of claim 1, wherein the monostringer beam includes rail standoffs configured for attachment of the stair tread brackets to the monostringer beam.

6. The floating modular stair system of claim 5, wherein the stair tread brackets are attachable to a rail standoff of the monostringer beam with compression fittings.

7. The floating modular stair system of claim 5, wherein the rail standoffs are configured to increase torsional rigidity of the monostringer beam.

8. The floating modular stair system of claim 1, wherein the stair tread brackets are each a multi-part bracket system, comprising:

a bracket base configured for attachment to the monostringer beam; and first and second bracket mounting plates attachable to the bracket base and configured to support a stair tread.

9. The floating modular stair system of claim 1, wherein the stair tread brackets are configured for leveling after attachment to the monostringer beam to level the stair treads of the floating modular stair system.

10. The floating modular stair system of claim 1, wherein each of the stair tread brackets are configured for individual variable angle adjustment and leveling, being rotatable through an adjustable anchor point about a fixed pivot anchor point.

11. A stair tread bracket of a floating modular stair system, the stair tread bracket, comprising:

a bracket base configured for attachment to a monostringer beam of the floating modular stair system; and a first bracket mounting plate configured for attachment to a first side of the bracket base and a second bracket mounting plate configured for attachment to a second side of the bracket base, the first and second bracket mounting plates each configured for the attachment to the respective first and second sides of the bracket base with an adjustable anchor point that is rotatable about a fixed pivot anchor point for leveling respective first and second stair tread anchor plates that are configured to support a stair tread of the floating modular stair system.

12. The stair tread bracket of claim 11, wherein the first and second bracket mounting plates are configured for individual leveling of the respective first and second stair tread anchor plates after the attachment to the bracket base to level the stair tread of the floating modular stair system.

13. The stair tread bracket of claim 11, wherein the first and second bracket mounting plates are each configured for the attachment to the bracket base with compression fittings through at least one of the adjustable anchor point and the fixed pivot anchor point.

14. The stair tread bracket of claim 11, wherein:

the monostringer beam is configured for variable angle adjustment; and the first and second bracket mounting plates are configured for individual leveling of the respective first and second stair tread anchor plates corresponding to a variable angle of the monostringer beam.

15. The stair tread bracket of claim 11, wherein the bracket base includes variable bracket attachment slots configured to facilitate translation of the bracket base parallel along the monostringer beam for the attachment to the monostringer beam.

16. A floating modular stair system, comprising:

a monostringer beam attachable to a wall mounting plate and to a base mounting plate; and stair tread brackets attachable to the monostringer beam for equal spacing of stair treads after installation of the monostringer beam to the wall mounting plate and to the base mounting plate, the stair tread brackets each being a multi-part bracket system that includes a bracket base configured for attachment to the monostringer beam, and first and second bracket mounting plates attachable to the bracket base and configured to support a stair tread.

17. The floating modular stair system of claim 16, wherein the stair tread brackets are adjustable after the installation to accommodate spacing variances in compliance with building codes.

18. The floating modular stair system of claim 16, wherein the stair tread brackets are adjustable for no distribution variation of the stair treads forming a flight of stairs.

19. The floating modular stair system of claim 16, further comprising an integrated hook attachment configured for variable angle adjustment and attachment of the monostringer beam to the wall mounting plate.

20. The floating modular stair system of claim 16, wherein the monostringer beam includes integrated set screw attachments configured to secure the monostringer beam at an installation angle of the monostringer beam attached to the wall mounting plate and to the base mounting plate.

* * * * *